US007137573B2

(12) United States Patent
Murai et al.

(10) Patent No.: US 7,137,573 B2
(45) Date of Patent: Nov. 21, 2006

(54) ROTARY ATOMIZATION COATING APPARATUS

(75) Inventors: Masaru Murai, Toyota (JP); Makoto Ichimura, Toyota (JP)

(73) Assignee: Toyota Jidosha Kabushiki Kaishi, Aichi-ken (JP)

( * ) Notice: Subject to any disclaimer, the term of this patent is extended or adjusted under 35 U.S.C. 154(b) by 143 days.

(21) Appl. No.: 10/782,887

(22) Filed: Feb. 23, 2004

(65) Prior Publication Data

US 2004/0195406 A1 Oct. 7, 2004

(30) Foreign Application Priority Data

Feb. 28, 2003 (JP) ..... 2003-053069

(51) Int. Cl.
*B05B 1/32* (2006.01)
*B05B 1/28* (2006.01)

(52) U.S. Cl. ..... 239/451; 239/452; 239/457; 239/290; 239/291; 239/293

(58) Field of Classification Search ..... 239/451, 239/452, 457, 290, 291, 293, 296, 394, DIG. 14
See application file for complete search history.

(56) References Cited

U.S. PATENT DOCUMENTS

| | | | | |
|---|---|---|---|---|
| 4,512,518 | A * | 4/1985 | Inukai | 239/223 |
| 4,643,357 | A * | 2/1987 | Culbertson et al. | 239/112 |
| 4,684,064 | A * | 8/1987 | Kwok | 239/223 |
| 4,919,333 | A * | 4/1990 | Weinstein | 239/223 |
| 4,927,081 | A * | 5/1990 | Kwok et al. | 239/223 |
| 6,623,561 | B1 * | 9/2003 | Vetter et al. | 118/314 |

FOREIGN PATENT DOCUMENTS

| | | |
|---|---|---|
| JP | 62-286566 | 5/1987 |
| JP | 08-215611 | 2/1996 |
| JP | 09-220497 | 2/1996 |

* cited by examiner

*Primary Examiner*—Davis Hwu
(74) *Attorney, Agent, or Firm*—Finnegan, Henderson, Farabow, Garrett & Dunner, LLP.

(57) ABSTRACT

In a rotary atomization coating apparatus having a center cone portion at a back side of an atomizer head inner part, the tip angle θ of the center cone portion is in the range of 30°<θ<90° with respect to a front side of the atomizer head inner part.

16 Claims, 8 Drawing Sheets

ROTARY ATOMIZATION COATING APPARATUS

INCORPORATION BY REFERENCE

The disclosure of Japanese Patent Application No. 2003-053069 filed on Feb. 28, 2003, including the specification, drawings and abstract thereof, is incorporated herein by reference in its entirety.

BACKGROUND OF THE INVENTION

1. Field of the Invention

The invention relates to a technology of a rotary atomization coating apparatus that atomizes coating material into fine or coarse particles and deposits coating material particles onto a coating-object piece. More particularly, the invention relates to a technology for improving the cleaning characteristic of a rotary atomization coating apparatus in which coating material is sprayed into a rotating center cone and the atomized coating material is jetted.

2. Description of the Related Art

A known rotary atomization coating apparatus has, at a tip of a coating gun, an atomizer head that is rotated at high speed, and performs the coating by atomizing a coating material via the atomizer head and controlling the shape of coating material spraying by using shaping air or the like. The atomizer head atomizes coating material by causing a center cone provided in an inner part to spray coating material and spraying coating material by centrifugal force.

In the rotary atomization coating apparatus, the changing of coating colors involves the cleaning of the apparatus. To clean the rotary atomization coating apparatus, a thinner or the like is supplied as a cleaning agent to an inner part of the atomizer head via an ejection opening. In order to improve the cleaning characteristic of a known rotary atomization coating apparatus in which an cleaning thinner passage extending from a back side of an atomizer head inner part to a front side of the atomizer head inner part is provided in a central portion of the atomizer head inner part, the thinner passage is designed so that a portion of the thinner passage portion located at a side of outlet to the front side of the atomizer head inner part has a shape that becomes progressively larger toward the front side of the atomizer head inner part (e.g., see Patent Literature 1).

[Patent Literature 1]

Japanese Patent Application Laid-Open Publication No. 8-215611

However, in the rotary atomization coating apparatus in which a cleaning thinner passage portion becomes progressively larger toward the front side of the atomizer head inner part, sprayed coating material may sometimes bounce inside the atomizer head inner part to deposit on an inner surface of the atomizer head inner part.

If inside the atomizer head inner part, coating material is sprayed to the back side of a forward portion of the atomizer head inner part, the coating material bounces from the back side of the forward portion of the atomizer head inner part and then deposits on the front side of a rearward portion of the atomizer head inner part.

SUMMARY OF THE INVENTION

In accordance with a first aspect of the invention, a rotary atomization coating apparatus includes a center cone portion that is provided at a back side of an atomizer head inner part and that has a tip angle θ that is in a range of $30° < \theta < 90°$.

In the first aspect of the invention, the tip angle θ of the center cone portion may be in a range of $60° < \theta < 80°$.

In the first aspect, the center cone portion may have an inclined surface portion that includes a straight line-formed portion, and the straight line-formed portion may extend from a tip portion of the center cone portion to a point where a virtual line extending from a outermost side portion of the coating spray nozzle passes through the inclined surface portion.

In the first aspect, the center cone portion may have an inclined surface portion that includes a concave portion, and the concave portion may be located outward of a point where a virtual line extending from a outermost side portion of the coating spray nozzle passes through the inclined surface portion.

In the first aspect, the rotary atomization coating apparatus may further include a plurality of coating spray nozzles.

In the first aspect, the rotary atomization coating apparatus may further include a coating spray nozzle that sprays a coating material to a location that is eccentric from a rotating axis of the atomizer head.

A second aspect of the invention is as described below.

A rotary atomization coating apparatus includes a center cone portion provided at a rearward portion of an atomizer head inner part, wherein an angle between an inclined surface portion of the center cone portion and a atomizer head rotating axis is in a range of 15° to 45°.

In the second aspect of the invention, the angle between the inclined surface portion of the center cone portion and the atomizer head rotating axis may be in a range of 30° to 40°.

In the second aspect, the center cone portion may have an inclined surface portion that includes a straight line-formed portion, and the straight line-formed portion may extend from a tip portion of the center cone portion to a point where a virtual line extending from a outermost side portion of the coating spray nozzle passes through the inclined surface portion.

In the second aspect, the center cone portion may have an inclined surface portion that includes a concave portion, and the concave portion may be located outward of a point where a virtual line extending from a outermost side portion of the coating spray nozzle passes through the inclined surface portion.

In the second aspect, the rotary atomization coating apparatus may further include a plurality of coating spray nozzles.

In the second aspect, the rotary atomization coating apparatus may further include a coating spray nozzle that sprays a coating material to a location that is eccentric from a rotating axis of the atomizer head.

A third aspect of the invention is as described below.

A rotary atomization coating apparatus includes a center cone portion provided at a rearward portion of an atomizer head inner part, wherein an angle between an inclined surface portion of the center cone portion and a coating spraying direction of a coating spray nozzle is in a range of 15° to 45°.

In the third aspect of the invention, the angle between the inclined surface portion of the center cone portion and the coating spraying direction of the coating spray nozzle may be in a range of 30° to 40°.

In the third aspect, the center cone portion may have an inclined surface portion that includes a straight line-formed portion, and the straight line-formed portion may extend from a tip portion of the center cone portion to a point where a virtual line extending from a outermost side portion of the coating spray nozzle passes through the inclined surface portion.

In the third aspect, the center cone portion may have an inclined surface portion that includes a concave portion, and the concave portion may be located outward of a point where a virtual line extending from a outermost side portion of the coating spray nozzle passes through the inclined surface portion.

In the third aspect, the rotary atomization coating apparatus may further include a plurality of coating spray nozzles.

In the third aspect, the rotary atomization coating apparatus may further include a coating spray nozzle that sprays a coating material to a location that is eccentric from a rotating axis of the atomizer head.

DETAILED DESCRIPTION OF THE PREFERRED EMBODIMENTS

Preferred embodiments of the invention will be described with reference to the accompanying drawings.

Figure 1A:
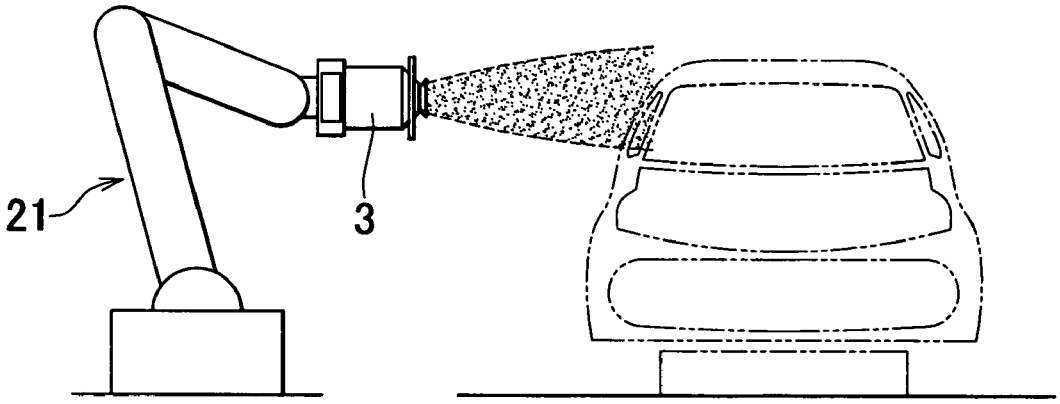
FIG. 1A is a diagram illustrating a rotary atomization coating apparatus according to a preferred embodiment of the invention attached to the manipulator of a painting robot.
Figure 1B:
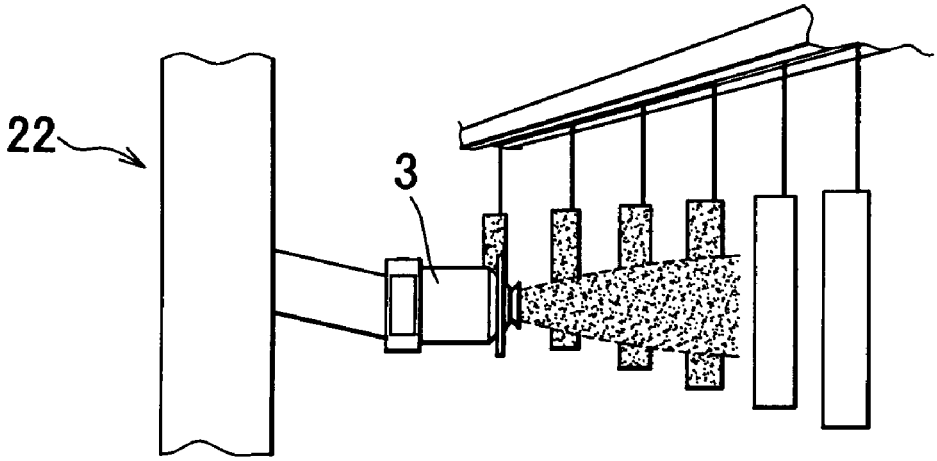
FIG. 1B is a diagram illustrating a rotary atomization coating apparatus according to a preferred embodiment of the invention attached to the manipulator of a vertical painting-dedicated automatic machine.
Figure 1C:
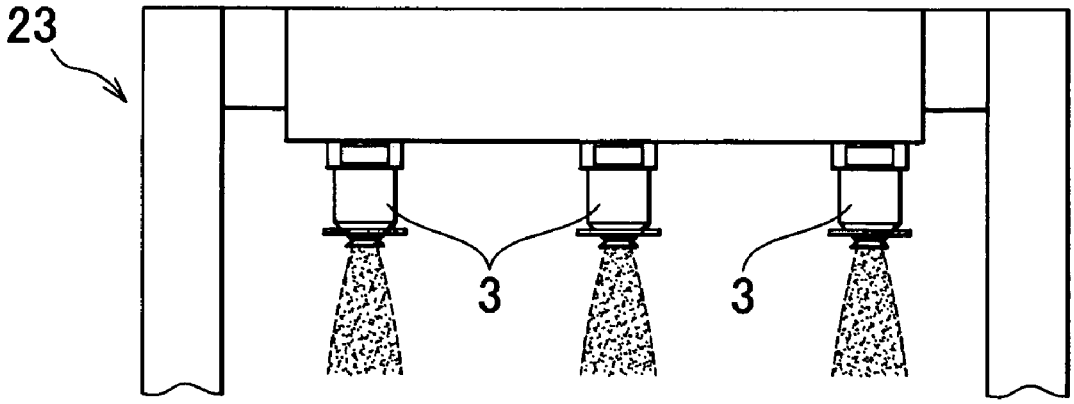
FIG. 1C is a diagram illustrating rotary atomization coating apparatuses according to a preferred embodiment of the invention attached to the manipulator of a horizontal painting-dedicated automatic machine.

FIGS. 1A to 1C illustrate examples of use of rotary atomization coating apparatuses. FIG. 1A shows a rotary atomization coating apparatus attached to the manipulator of a painting robot. FIG. 1B shows a rotary atomization coating apparatus attached to the manipulator of a vertical painting-dedicated automatic machine. FIG. 1C shows rotary atomization coating apparatuses attached to the manipulator of a horizontal painting-dedicated automatic machine.

As shown in FIGS. 1A to 1C, rotary atomizers 3, i.e., rotary atomization coating apparatuses, are attached to the manipulator of a painting robot 21, the manipulator of a vertical painting-dedicated automatic machine 22 or the manipulator of a horizontal painting-dedicated automatic machine 23, when the rotary atomizers are used. Therefore, the rotary atomizers 3 need to be automatically cleaned. If a rotary atomizer 3 has been used for a certain amount of coating or the color of coating is to be changed, the rotary atomizer 3 is cleaned by supplying a cleaning agent to the rotary atomizer 3. The cleaning agents normally used for rotary atomizers 3 are volatile organic compounds (VOC) such as a thinner or the like. Therefore, if the cleaning efficiency of rotary atomizers 3 is improved, the use of VOC will reduce and the production efficiency will improve due to a reduced cleaning time. Furthermore, prevention of fouling or the like inside the rotary atomizer 3 will improve the coating quality.

Figure 2:
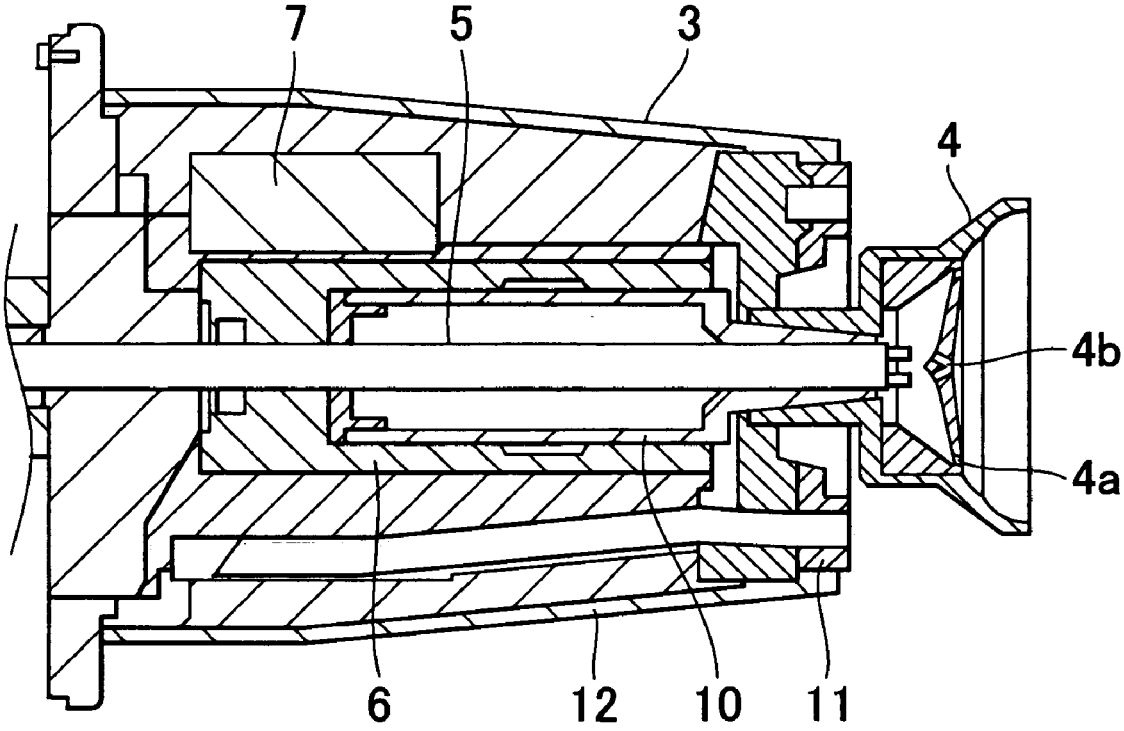
FIG. 2 is a side sectional view of a rotary atomization coating apparatus according to a preferred embodiment of the invention.

The construction of the rotary atomizer 3 will be described with reference to FIG. 2. FIG. 2 is a side sectional view of the rotary atomizer. Referring to FIG. 2, the rotary atomizer 3 has a bell head (rotary atomizer head) 4 that atomizes coating material, a hollow rotating shaft 10 that is connected at its distal end to the bell head 4 and that rotates together with the bell head 4 as one unit, an air motor 6 (including an air bearing that rotatably supports the rotating shaft 10) that rotates the rotating shaft 10, a coating material shaft 5 that extends through the hollow of the rotating shaft 10 to an interior of the bell head 4 and supplies coating material to the bell head 4, an air cap 11 having an air nozzle that jets shaping air forward toward the coating material flying from an outer peripheral edge of the bell head 4 in radially outward directions, a high-voltage generator 7 that generates high voltage to be applied to the bell head 4, and a casing 12. The bell head 4 has coating jet holes 4*a* that are formed in an outer peripheral portion of a wall portion facing the distal end of the coating material shaft 5 so as to conduct coating material during the coating process, and a self-cleaning path 4*b* that is formed in a central portion of the wall portion so as to conduct a cleaning agent during cleaning.

High voltage is applied to the bell head 4 from the high-voltage generator 7 via the air motor 6, the coating material shaft 5, etc. so as to electrically charge the coating particles formed due to rotation of the bell head 4. This allows a coating process with high coating transfer efficiency.

Next, the bell head 4 will be described with reference to FIGS. 3 to 5B.

Figure 3:
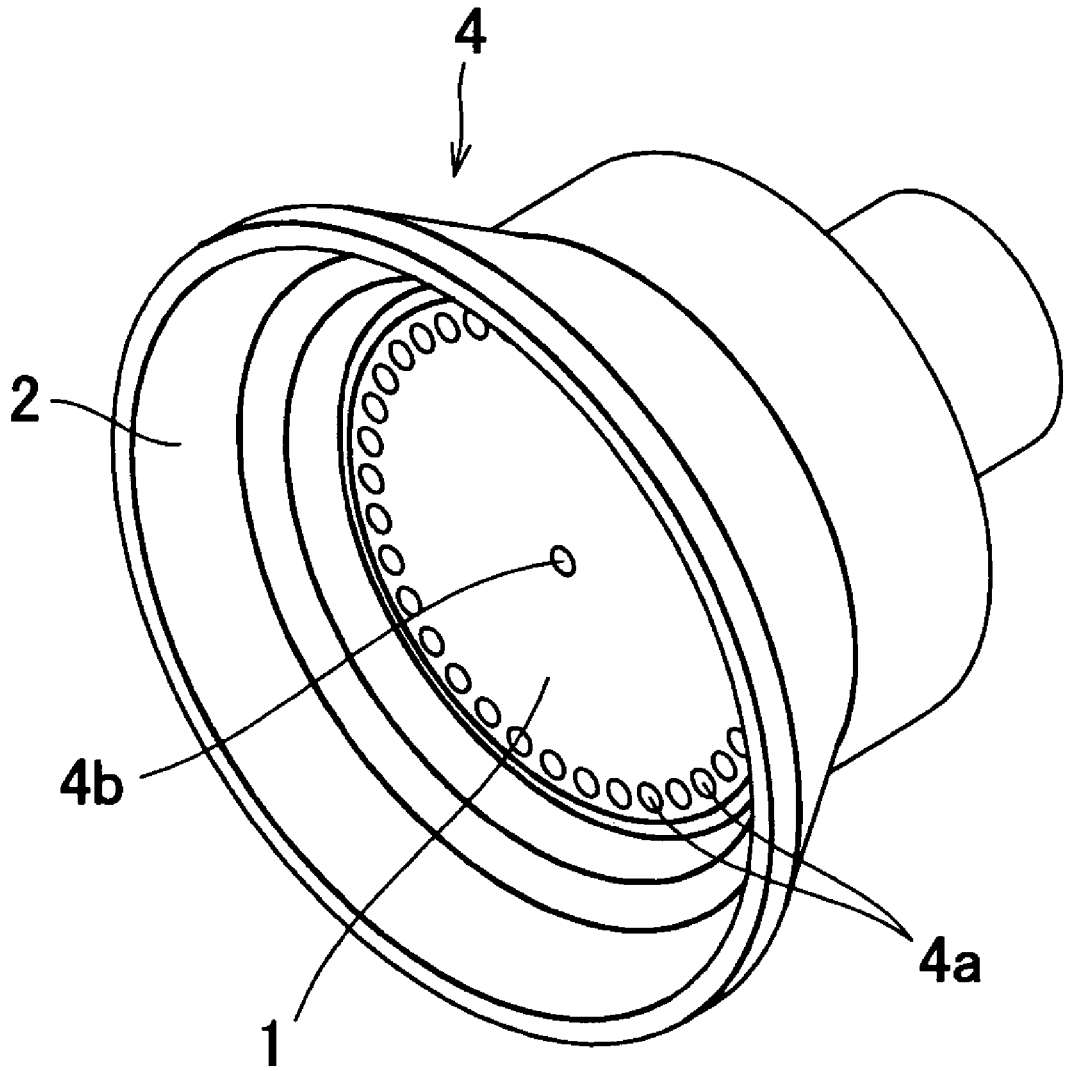
FIG. 3 is a perspective view of a bell head according to a preferred embodiment of the invention.
Figure 4:
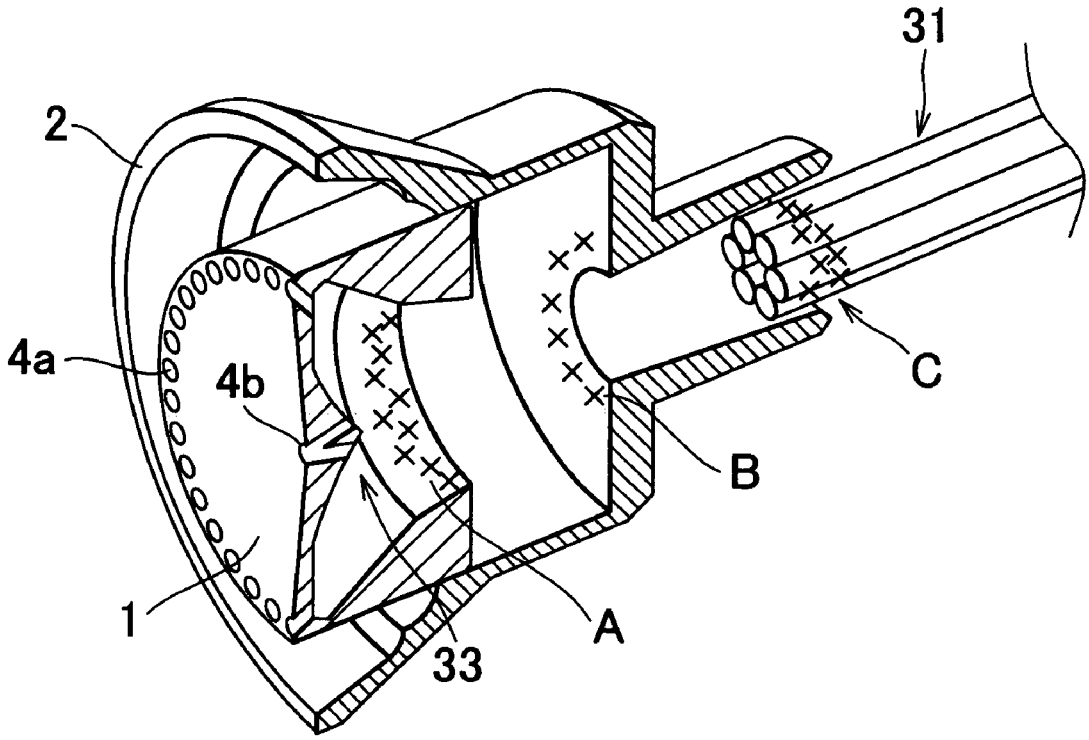
FIG. 4 is a sectional view of a bell head according to a preferred embodiment of the invention illustrating the assembled construction thereof.
Figure 5A:
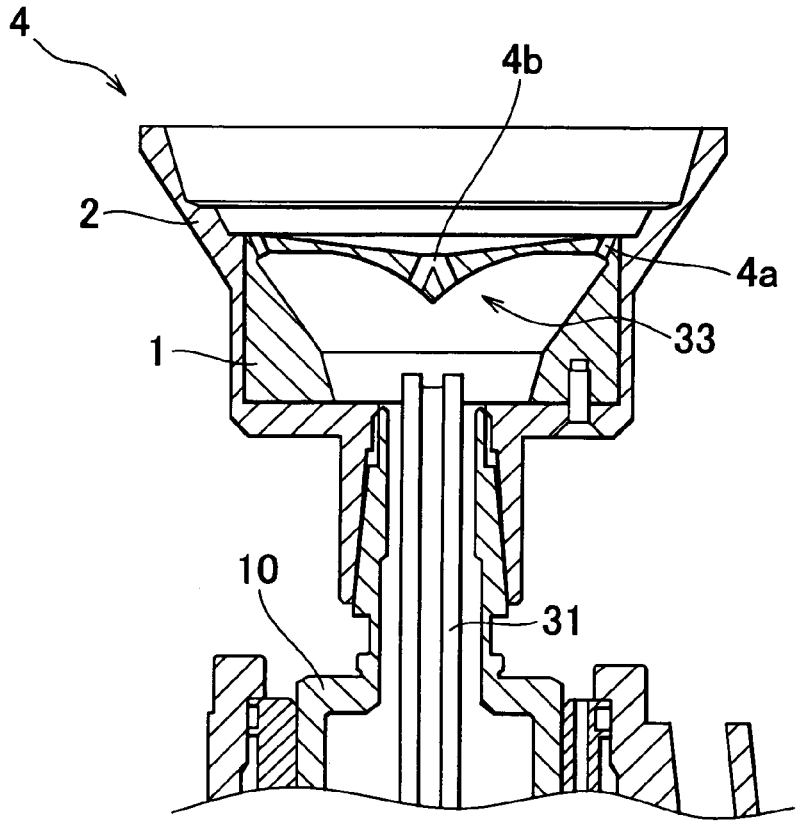
FIG. 5A is a side sectional view illustrating the construction of an atomizer head inner and an spray nozzle according to a preferred embodiment of the invention.

FIG. 3 is a perspective view of the bell head. FIG. 4 is a sectional view of the bell head illustrating the assembled construction thereof. FIG. 5A is a side sectional view illustrating the construction of an atomizer head inner and an spray nozzle.

The bell head 4 is made up of an atomizer head inner part 1 and an atomizer head outer part 2. The atomizer head inner part 1 is inserted and fixed to the atomizer head outer part 2 to form the bell head 4. The atomizer head outer part 2 has, in a forward portion thereof, an opening for insertion of the atomizer head inner part 1, and further has, in a rearward portion thereof, an opening for insertion of a multi-feed tube 31 that forms the coating material shaft. The atomizer head outer part 2 has a bell or trumpet-like shape, in which the side of the larger opening is defined as a forward side.

The atomizer head inner part 1 has a drum-like shape with a rearward opening. A center cone 33 is formed on the back side of a front portion of the atomizer head inner part 1. The front portion of the atomizer head inner part 1 is provided with the coating jet holes 4*a* and the self-cleaning path 4*b*, whereby communication between the outside and the inside of the atomizer head inner part 1 is established.

The multi-feed tube 31 is inserted into the rear opening of the atomizer head outer part 2 of the bell head 4, thereby allowing coating material to be supplied into the atomizer head inner part 1. The multi-feed tube 31 is a bundle of a plurality of tubes 32, 32, . . . , and each tube 32 is capable of supplying coating material. During high-speed rotation of the bell head 4, coating material is sprayed into the atomizer head inner part 1, and is sprayed from the coating jet holes 4*a* of the atomizer head inner part 1. The multi-feed tube 31 is disposed in such a manner that the multi-feed tube 31 is directed toward the inner side of the front portion of the atomizer head inner part 1. The inner side of the front portion of the atomizer head inner part 1 is provided with the center cone 33 protruding rearward. A tip portion of the center cone 33, that is, a rearmost protruded portion thereof, is positioned on a center axis of rotation of the bell head, and has a circular cone shape with an expanded bottom portion.

In related-art bell heads, portions A, B and C indicated by markings X in FIG. 4 often have deposits of coating material due to reverse flows, thereby degrading the cleaning characteristic. That is, the coating material sprayed from the multi-feed tube 31 impinges on the inner surface of the atomizer head inner part 1, and bounces to deposit on the portion A near the rear opening of the atomizer head inner part 1, the portion B that is a connecting surface of the atomizer head outer part 2 to the atomizer head inner part 1 and that is adjacent to the portion for insertion of the multi-feed tube 31, and the portion C near the ejection openings of the multi-feed tube 31.

Figure 5B:
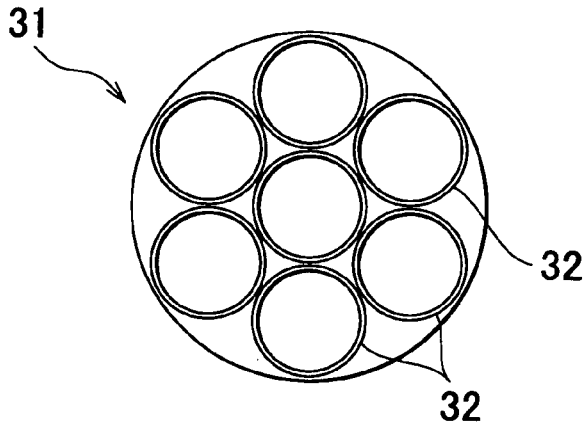
FIG. 5B is a front elevation of an spray nozzle according to a preferred embodiment of the invention.

FIG. 5B is a front elevation of the multi-feed tube 31 illustrating the arrangement thereof. As shown in FIG. 5B, the multi-feed tube 31 is formed by bundling a plurality of tubes 32. In this arrangement, some of the tubes 32 spray coating material to locations apart from the rotation center of the bell head 4, that is, eccentric positions relative to the rotating axis of the bell head 4. Therefore, if the atomizer head inner part 1 is shaped so as to become progressively larger toward the front surface of the atomizer head inner part 1 as in the related-art technology, the side surface of the center cone, at the eccentric positions, faces the ejection openings of the tubes 32, so that the sprayed coating material is likely to bounce at the eccentric positions and flow backward and therefore deposit on inner surfaces of the bell head 4.

Figure 6A:
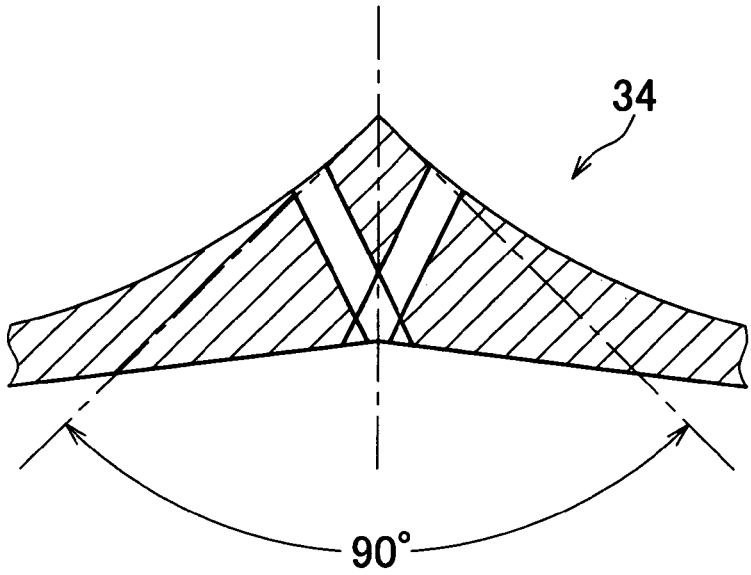
FIG. 6A RELATED ART
FIG. 6A is a side sectional view of a related-art center cone.
Figure 6B:
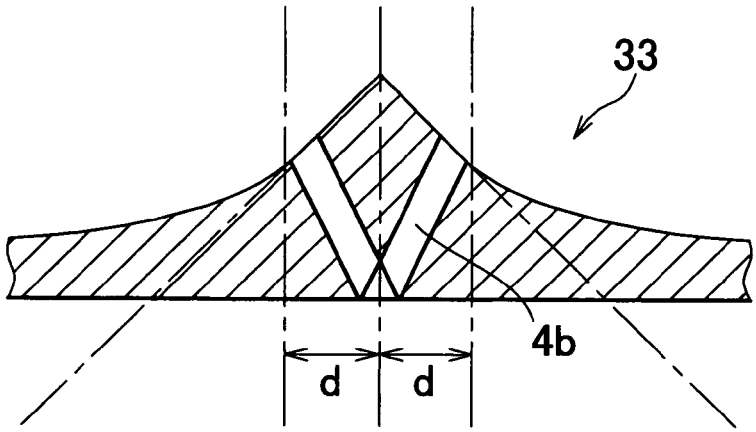
FIG. 6B is a side sectional view of a center cone according to a preferred embodiment of the invention.

The center cone 33 formed in a forward portion of the atomizer head inner part 1 will be described. FIGS. 6A and 6B are side sectional views of center cones according to the related-art technology and the embodiment of the invention. FIG. 6A is a side sectional view of a center cone according to the related-art technology, and FIG. 6B is a side sectional view of the center cone according to the embodiment of the invention.

In the shape of a center cone 34 of the related-art technology shown in FIG. 6A, the vertex angle of a tip portion is 90° in a side view. In FIG. 6A, the lateral surface of a vertex portion has an angle of 45° with respect to a vertical direction. The center cone 34 is formed so that the angle of the lateral surface with respect to the vertical direction becomes progressively greater toward the base end surface. That is, the center cone 34 of the related-art technology has a shape in which the lateral surface gradually changes to a substantially horizontal surface from the vertex toward the base end surface.

In contrast, in the embodiment of the invention, a fixed angle of the lateral surface of the center cone 33 is maintained over a certain region extending from the vertex as indicated in FIG. 6B. Outward of the region, the angle of the lateral surface gradually expands, that is, the lateral surface gradually approaches a horizontal plane, toward the base end surface. That is, the vertex of the center cone 33 is located on the rotating axis of the bell head. In a predetermined region from the rotating axis of the bell head, that is, in the region of a radius d from the rotating axis of the bell head, the angle formed by the lateral surface, that is, a conical surface, of the center cone 33 across the vertex is smaller than 90° in a side view. Outside the predetermined region, that is, outside the region of the radius d from the rotating axis of the bell head, the angle formed between the lateral surface of the center cone and the rotating axis of the bell head is gradually increased toward 90°, and is further increased over 90°.

The bouncing of coating material toward the ejection opening side when the coating material is sprayed to the vertex portion can be curbed if the angle formed between an inclined surface portion of the center cone 33 and the rotating axis of the atomizer head (angle between the inclined surface portion of the center cone and the direction of spray of coating material from the coating material spray nozzles) is set in the range of 45° to 15°, that is, if the vertex angle θ satisfies the condition of $90° > \theta > 30°$. The optimal angel of a vertex portion varies depending on the physical properties of coating materials. If the vertex angle θ is set in the range of $80° > \theta > 60°$, the bouncing of coating material is curbed, so that the good cleaning characteristic can be achieved as well. A most preferable vertex angle θ is in the range of $75° > \theta > 70°$.

That is, an inclined surface portion of the center cone 33 extending from the tip, that is, the vertex, to a point where a virtual line extending from a outermost side portion of the coating spray nozzle passes through the inclined surface portion is formed as a straight line-formed surface, more specifically, a conical surface generated by moving a straight line around the vertex. An inclined surface portion of the center cone 33 extending outward of the point where a virtual line extending from a outermost side portion of the coating spray nozzle passes through the inclined surface portion is formed as a generally concave surface. This configuration of the center cone 33 prevents reverse flows of various kinds of coating materials.

Figure 7:
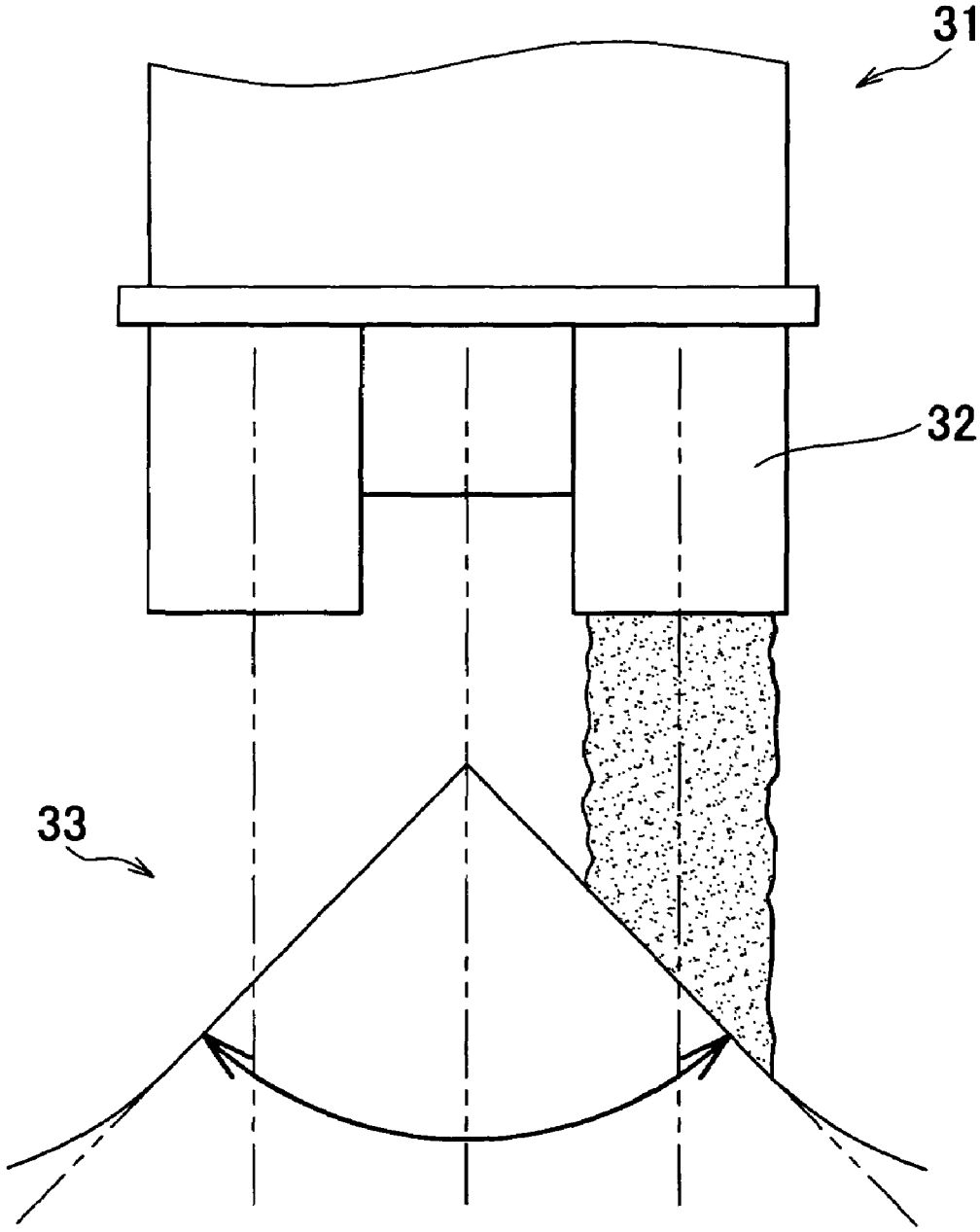
FIG. 7 is a side sectional view illustrating a relationship between a multi-feed tube and a center cone nozzle according to a preferred embodiment of the invention.

Next, a relationship between the center cone 33 and the multi-feed tube 31, that is, the coating ejection openings, will be described with reference to FIG. 7. FIG. 7 is a side view illustrating the relationship between the multi-feed tube and the center cone.

In the center cone 33, the region of lateral surface where the angle of lateral surface is kept fixed is predetermined as a portion of the lateral surface that is directly struck by the coating material sprayed from the multi-feed tube 31. Therefore, the bouncing of the coating material sprayed by the multi-feed tube 31 from the center cone 33 is curbed.

The lateral surface portion of the center cone 33 struck by coating material is formed so as to have a straight line shape in a side view. The lateral surface portion appearing straight in a side view may be made larger than the surface portion on which coating material directly impinges, in order to reliably curb reverse flows caused by the bouncing of coating material.

Thus, if the tip angle of the center cone 33 is set less than 90° and the straight slope, that is, the truly conical surface, is set larger than the coating material impingement surface, the coating material dispersion force after the impingement of coating material on the center cone 33 becomes greater in directions toward an outer side of the center cone 33, so that coating material tends to flow outward relative to the center cone 33 and the force that bounces coating material toward a central portion reduces. Therefore, inside the atomizer head inner part 1, coating material disperses radially outward, and reverse flows of coating material is substantially prevented.

With regard to a center cone according to the related art and a center cone according to the embodiment of the invention, the state of bouncing of coating material and the cleaning effect were investigated.

The related-art center cone used for the investigation had a vertex angle of 90°, and had a configuration in which the angles between vectors normal to the lateral surface and the bell head rotation axis became progressively smaller from the vertex toward the direction of spray of coating material. The center cone according to the embodiment had a vertex angle greater than 30° but less than 90°, and had a configuration in which a fixed angle between vectors normal to the lateral surface and the bell head rotation axis was maintained in the region of lateral surface extending from the vertex to a surface portion of direct impingement of coating material. Radially outward of the surface portion of direct impingement of coating material, the angles between vectors normal to the lateral surface and the bell head rotation axis became progressively smaller toward the direction of spray of coating material.

The related-art center cone and the center cone of the embodiment of the invention described above were set in rotary atomization coating apparatuses, and were used for spray of 900 cc of coating material in 15 seconds. Subsequently, the states of the center cones were visually observed. After that, a process of spraying a thinner for 0.5 second and spraying air for 0.5 second was performed three times. Subsequently, the state of cleaning of each center cone was visually observed.

As for the related-art center cone, large amounts of bounced coating material deposited on the portions A, B, C indicated in FIG. 4. After the cleaning, it was observed that the fouling on the portion B of the atomizer head outer part 2 and the portion A of the atomizer head inner part 1 reduced whereas the fouling on the portion C near the ejection openings of the multi-feed tube 31 remained.

As for the center cone of the embodiment of the invention, thin deposits of bounced coating material existed on the portions A, B indicated in FIG. 4, and only a small amount of coating material deposited on the portion C. After the cleaning, substantially no fouling was observed on any one of the portion A, B and C.

As can be understood from the foregoing description, the use of a rotary atomization coating apparatus according to the invention reduces the deposit of coating material inside the rotary atomization coating apparatus, and improves the cleaning characteristic of the apparatus. Therefore, the time needed for changing coating colors during a coating process can be reduced, and the time needed for the coating process as a whole can be reduced. Furthermore, the improved cleaning characteristic will reduce the use of VOC for the cleaning.

More specifically, in a rotary atomization coating apparatus having a center cone portion at a back side of an atomizer head inner part, the tip angle θ of the center cone portion is set in the range of 30°<θ<90° with respect to a front side of the atomizer head inner part. Therefore, the coating dispersing due to impingement on the center cone is prevented from reversely flowing, so that the fouling in the rotary atomization coating apparatus will reduce. Correspondingly, the cleaning efficiency of the rotary atomization coating apparatus will improve, so that the time needed for the changing of coating colors can be reduced.

Furthermore, in a rotary atomization coating apparatus having a center cone portion at a back side of an atomizer head inner part, the tip angle θ of the center cone portion is set in the range of 60°<θ<80° with respect to a front side of the atomizer head inner part. Therefore, with regard to many kinds of coating materials, the apparatus prevents reverse flows of dispersed coating material, and reduces the fouling in the apparatus.

Still further, the straight line-formed portion extends from the tip portion of the center cone portion to a point where a virtual line extending from a outermost side portion of the coating spray nozzle passes through the inclined surface portion. Therefore, the coating dispersing after impinging on the center cone is prevented from reversely flowing, so that the fouling in the rotary atomization coating apparatus will reduce. Furthermore, the cleaning efficiency of the rotary atomization coating apparatus will improve, so that the time needed for changing coating colors can be reduced. Furthermore, the configuration of the center cone can be simplified, so that the production cost thereof can be reduced. The cleaning characteristic of the center cone portion, in particular, can be improved.

The concave portion is located outward of a point where a virtual line extending from a outermost side portion of the coating spray nozzle passes through the inclined surface portion. Therefore, it is possible to reliably prevent reverse flows of dispersed coating while maintaining the atomized coating jetting characteristic of the rotary atomization coating apparatus. Furthermore, since smooth flows of coating and a cleaning liquid are formed on the center cone, the fouling of the interior of the rotary atomization coating apparatus becomes less likely and the cleaning thereof becomes easier.

Since a plurality of coating spray nozzles are provided, the apparatus of the invention is adaptable to various kinds of rotary atomization coating apparatuses. Furthermore, the range of nozzle positioning can be enlarged, and stable coating performance can be maintained.

What is claimed is:

1. A rotary atomization coating apparatus comprising:

an atomizer head having an atomizer head inner part; and a center cone portion that is provided at a back side of the atomizer head inner part and that has a tip angle θ that is in a range of 30°<θ<90°;

wherein the center cone portion has an inclined surface portion that includes a straight line-formed portion, and the straight line-formed portion is located outward of a tip portion of the center cone portion, the straight line-formed portion includes a point where a virtual line extending from an outermost side portion of a coating spray nozzle passes through the inclined surface portion, and the inclined surface portion includes a concave portion which is located outward of an outermost side of the straight-line formed portion.

2. The rotary atomization coating apparatus according to claim 1, wherein the tip angle θ of the center cone portion is in a range of 60°<θ<80°.

3. The rotary atomization coating apparatus according to claim 1, further comprising a coating spray nozzle, wherein the straight line-formed portion extends from the tip portion of the center cone portion to a point where the virtual line extending from the outermost side portion of the coating spray nozzle passes through the inclined surface portion.

4. The rotary atomization coating apparatus according to claim 1, wherein the center cone portion has an inclined surface portion that includes a concave portion, and the concave portion is located outward of a point where the virtual line extending from the outermost side portion of the coating spray nozzle passes through the inclined surface portion.

5. The rotary atomization coating apparatus according to claim 1, further comprising a plurality of coating spray nozzles.

6. The rotary atomization coating apparatus according to claim 1, wherein the coating spray nozzle sprays a coating material to a location that is eccentric from a rotating axis of the atomizer head.

7. A rotary atomization coating apparatus comprising:

an atomizer head having an atomizer head inner part; and a center cone portion provided at a back side of the atomizer head inner part, which has an inclined surface portion, wherein an angle between the inclined surface portion of the center cone portion and the atomizer head rotating axis is in a range of 15°to 45°;

wherein the center cone portion has the inclined surface portion that includes a concave portion, and the concave portion is located outward of a point where a virtual line extending from a outermost side portion of a coating spray nozzle passes through the inclined surface portion.

8. The rotary atomization coating apparatus according to claim 7, wherein the angle between the inclined surface portion of the center cone portion and the atomizer head rotating axis is in a range of 30°to 40°.

9. The rotary atomization coating apparatus according to claim 7, wherein the straight line-formed portion extends from the tip portion of the center cone portion to a point where a virtual line extending from a outermost side portion of the coating spray nozzle passes through the inclined surface portion.

10. The rotary atomization coating apparatus according to claim 7, further comprising a plurality of coating spray nozzles.

11. The rotary atomization coating apparatus according to claim 7, wherein the coating spray nozzle sprays a coating material to a location that is eccentric from a rotating axis of the atomizer head.

12. A rotary atomization coating apparatus comprising:

an atomizer head having an atomizer head inner part; and a center cone portion provided at a back side of the atomizer head inner part, which has an inclined surface portion, wherein an angle between the inclined surface portion of the center cone portion and a coating spraying direction of a coating spray nozzle is in a range of 15°to 45°;

and further wherein the coating spray nozzle sprays a coating material to a location that is eccentric from a rotating axis of the atomizer head.

13. The rotary atomization coating apparatus according to claim 12, wherein the angle between the inclined surface portion of the center cone portion and the coating spraying direction of the coating spray nozzle is in a range of 30°to 40°.

14. The rotary atomization coating apparatus according to claim 12, wherein the center cone portion has the inclined surface portion that includes a straight line-formed portion, and the straight line-formed portion extends from the tip portion of the center cone portion to a point where a virtual line extending from a outermost side portion of the coating spray nozzle passes through the inclined surface portion.

15. The rotary atomization coating apparatus according to claim 12, further comprising a coating spray nozzle, wherein the center cone portion has the inclined surface portion that includes a concave portion, and the concave portion is located outward of a point where a virtual line extending from a outermost side portion of the coating spray nozzle passes through the inclined surface portion.

16. The rotary atomization coating apparatus according to claim 12, further comprising a plurality of coating spray nozzles.

* * * * *

UNITED STATES PATENT AND TRADEMARK OFFICE

CERTIFICATE OF CORRECTION

PATENT NO. : 7,137,573 B2
APPLICATION NO. : 10/782887
DATED : November 21, 2006
INVENTOR(S) : Masaru Murai et al.

It is certified that error appears in the above-identified patent and that said Letters Patent is hereby corrected as shown below:

Claim 7, col. 9, line 23, "15°to" should read --15° to--.

Claim 7, col. 9, line 27, "a outermost" should read --an outermost--.

Claim 8, col. 9, line 33 "30°to" should read --30° to--.

Claim 9, col. 9, line 38, "a outermost" should read --an outermost --.

Claim 12, col. 10, line 12, "15°to" should read --15° to--.

Claim 13, col. 10, line 19, "30°to" should read --30° to--.

Claim 14, col. 10, line 28, "a outermost" should read --an outermost--.

Claim 15, col. 10, line 36, "a outermost" should read --an outermost--.

Signed and Sealed this

Tenth Day of April, 2007

JON W. DUDAS
*Director of the United States Patent and Trademark Office*